United States Patent [19]

Davis et al.

[11] 4,018,575

[45] Apr. 19, 1977

[54] LOW DENSITY ABRASIVE ARTICLE

[75] Inventors: John E. Davis, Maplewood; Thomas R. McAvoy, Stillwater, both of Minn.

[73] Assignee: Minnesota Mining and Manufacturing Company, St. Paul, Minn.

[22] Filed: Mar. 18, 1974

[21] Appl. No.: 451,995

[52] U.S. Cl. ..... 51/295; 51/294; 51/298 A

[51] Int. Cl.[2] ..... B24D 11/02

[58] Field of Search ..... 51/293, 295, 296, 298, 51/294

[56] References Cited

UNITED STATES PATENTS

| | | | |
|---|---|---|---|
| 2,740,725 | 4/1956 | Ball | 51/298.1 |
| 2,958,593 | 11/1960 | Hoover et al. | 51/295 |
| 2,972,554 | 2/1961 | Muskat et al. | 51/296 |
| 3,016,294 | 1/1962 | Haywood | 51/298.1 |
| 3,020,139 | 2/1962 | Camp et al. | 51/295 |
| 3,044,891 | 7/1962 | Lauchenauer | 51/298 |
| 3,146,560 | 9/1964 | Hurst | 51/293 |
| 3,260,582 | 7/1966 | Zimmer et al. | 51/293 |
| 3,529,945 | 9/1970 | Charvat | 51/295 |
| 3,619,149 | 11/1971 | Kitazawa | 51/294 |

*Primary Examiner*—Donald J. Arnold
*Attorney, Agent, or Firm*—Cruzan Alexander; Donald M. Sell; Richard Francis

[57] ABSTRACT

A low-density abrasive article, especially suited for scouring steel griddle surfaces without causing undesirable surface roughness thereto, comprises a lofty, open, fibrous web of curved continuous glass filament bundles which is impregnated with a hard thermoset resin containing abrasive particles.

9 Claims, 2 Drawing Figures

LOW DENSITY ABRASIVE ARTICLE

BACKGROUND OF THE INVENTION

The invention relates to low-density abrasive articles which are especially suited for cleaning commercial griddles.

A commercial griddle is typically a large expanse of steel mounted in a fixed position above heating elements to provide a large heated surface for frying various foods. Such equipment is common to nearly every restaurant and is in almost continuous use in so-called "fast food" restaurants.

Cleaning the cooking surface of a commercial griddle has been a problem which has defied simple solution. Cooking residues tenaciously adhere to this surface even if attempts are made to clean and scrape food therefrom after each cooking operation.

Repeated use builds and bakes the residues to form an unsightly troublesome carbonized crust. Not only does this crust interfere with cooking, causing subsequently cooked foods to stick and/or to taste burned or of the previously cooked food, but it acts as an insulating layer which interferes with normal cooking operations. Therefore, after an extended period of use, the griddle surface must be cleaned of residues. The usual way to clean a griddle surface is to abrade it with an abrasive article such as a block of pumice or glass foam. Such cleaning is usually done while the griddle is hot and possibly with a lubricating liquid such as oil or soapy water.

Pumice and glass foam blocks are rigid and inflexible and will not conform to the upturned edges of a commercial griddle. Although pumice and glass foam eventually do a moderately good job of cleaning griddle surfaces, they cut the griddle steel excessively, creating minute deep scratches into which the food residues can collect, and are more difficult to remove on subsequent cleaning. Pumice and glass foam also leave large quantities of unsightly attrited residues which must be removed from the griddle surface.

A scrim-backed abrasive product, as disclosed in Ball, U.S. Pat. No. 2,740,725, has met with some commercial success in use as a griddle cleaner but this product is not entirely satisfactory because of its relatively thin structure which fills easily with residues and makes it difficult to handle. Thicker nonwoven abrasive products such as described in Hoover et al, U.S. Pat. No. 2,958,593, which may at first be thought to be useful on griddle surfaces, are comprised of thermoplastic fibers which will collapse under normal griddle cleaning operations which, as previously stated, are typically accomplished while the griddle is hot.

SUMMARY OF THE PRESENT INVENTION

The present invention provides a low-density abrasive article especially suited for scouring steel griddle surfaces without causing undesirable surface roughness thereto. The abrasive article in non-clogging due to its open, lofty nature, therefore it can easily be rinsed of food residues after use and reused again and again. The abrasive article does not leave attrided residues as do pumice and glass foam. The abrasive article has a sufficient thickness to make it easily handleable yet it is sufficiently flexible to conform to all areas of the griddle surface including the curved portions.

The web of the abrasive article is formed of glass filaments; therefore it is unaffected by the heat of the griddle during cleaning and will retain its lofty fiber structure throughout the cleaning operation. The abrasive particles are sufficiently abrasive to remove typical cooking residues yet not so abrasive so as to cause undesirable surface roughness to the griddle surface. The abrasive particles are firmly bonded in the product, substantially completely preventing particle attrition during use.

BRIEF DESCRIPTION OF THE DRAWING

The invention can best be understood and appreciated by reference to the accompanying drawing wherein.

DETAILED DESCRIPTION OF THE PREFERRED EMBODIMENTS

Figure 1:
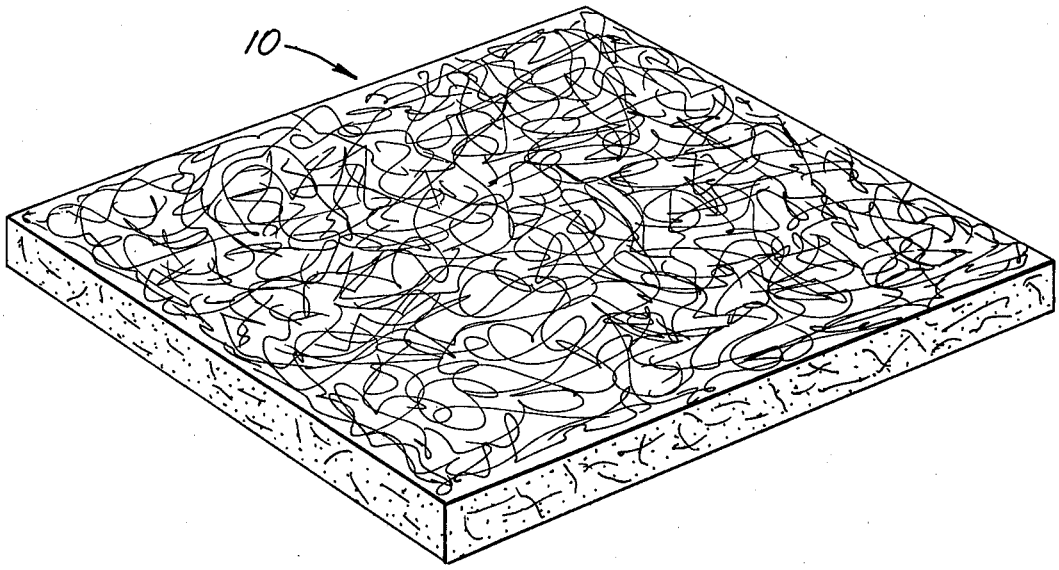
FIG. 1 wherein an abrasive article according to the invention is shown in a perspective view.
Figure 2:
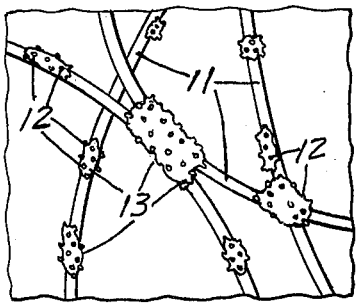
FIG. 2 is a fragmentary plan view showing a segment of the abrasive article in greater detail.

In accordance with the invention, a lofty, open, low-density, fibrous web formed of curved continuous flexible glass filament bundles 11 is impregnated with a relatively soft resinous prebonding composition. Abrasive particles 12 are dispersed throughout the exposed surface of the filament bundles of the web by a hard thermoset resin which forms an adherent bond with the prebonding composition and which holds the abrasive particles 12 and glass filament bundles 11 in a dimensionally stable structure, providing abrasive article 10. The thermoset resin uniformly coats portions of the filaments and forms globules 13 which may encircle individual filament bundles, adhere to the surface of the filament bundle and/or collect at the intersection of contacting filaments, providing abrasive sites throughout the abrasive article.

The lofty, open, low-density fibrous web which forms the structure of the abrasive article of the invention is formed of continuous curved glass filament bundles. The filament bundles are preferably disposed in substantially parallel planes one on another to form a web structure of a desired thickness. A convenient web thickness for cleaning griddles has been found to be on the order of 2 to 10 mm. At less than 2 mm, the product may be useful but it has insufficient void volume for collection of residue. At a thickness greater than 10 mm, the product is not easily flushed clean of residues.

The filament bundles forming the web are preferably comprised of a plurality of parallel minute glass filaments which are flexible but not brittle. For this purpose it has been found that individual glass filaments on the order of 2–10 denier are preferred while filament bundles of about 150–250 denier have been found to be suitable. It is preferred that the glass filaments be substantially continuous, i.e., with very few terminations within a web. Short filaments are not desired because they produce a dense, closed product.

The void volume of the web, before it is treated as hereinafter described, should be on the order of 92 to 98% to retain its desired cleanability and flexibility and for ease of processing. Web void volumes less than about 90% are not preferred because such webs will be too dense for the processing steps hereinafter described. Impregnation of such dense webs with bonding resins tends to coat the entire web making a stiff board-like product rather than impregnating the filaments to produce an open porous product. At void volumes greater than 98% the web structure is too weak to handle easily.

The webs described above and useful in the present invention are commercially available from the Owens/-Corning Company, for example, as that sold under the trade designation "M8620".

As previously mentioned, the web is treated with a relatively soft resinous prebonding composition which completely impregnates the glass filament bundles sufficient to bond them together at their points of intersection and to form a tough adherent prebonding interface between the glass filament bundles and the thermoset resin which overcoats it. By "relatively soft" is meant the prebonding resin has a Knoop hardness value no greater than about 4. The relatively soft prebonding resin is required for the abrasive article to have a long and useful life. Abrasive articles not having sufficient prebonding resin will have an unsatisfactory short wear life due to the brittle nature of the hard thermoset resin. Use of a prebonding resin having a Knoop hardness value greater than about 4 has the same effect.

The preferred prebonding resins are polyacrylates, butadiene-acrylonitrile rubbers and polyurethanes. Useful commercial polyacrylates include those sold under the trade designations "Rhoplex HA-8", "Rhoplex HA-12", "Rhoplex HA-16" and "Rhoplex HA-24". A useful commercial butadiene-acrylonitrile rubber is sold under the trade designation "Hycar 1562".

The prebonding resin should provide a dry add-on weight on the order of 50 to 250 grams per sq. meter to obtain sufficient bonding and produce an abrasive article having a useful wear life. With more than this amount of prebonding resin, the resultant product becomes stiff and does not conform easily to curved surfaces. At less than this amount of prebonding resin, the resulting product will not have a satisfactory wear life.

The low-density abrasive article of the invention is impregnated with a hard thermosetting bonding resin-/abrasive slurry to permanently bond the glass filament bundles together and to hold the abrasive on the filament bundle surfaces. The bonding resin, when dried, adherently bonds the filament bundles together and securely holds the abrasive particles within the web. The hard thermoset resin should have a Knoop hardness value of at least 15 to provide a tough useful product. The thermoset resin is sufficiently heat resistant to withstand temperatures of about 150° C. for prolonged periods and temperatures of about 250° C. for brief periods of time. Useful thermoset resins include phenolic resins such as phenolaldehyde resin, epoxy resins and polyisocyanurates. Other resins which harden to an infusible, thermoset, tough product may also be used. The preferred thermoset resin is a phenolformaldehyde resin. The thermoset resins may be blended with other resins to improve its properties such as making it more flexible or stronger.

The abrasive particles utilized are those which are sufficiently abrasive to cut griddle steel and of a size which do not cause undesirable scratching. For this purpose the abrasive particles are between about 30 microns and 250 microns in average diameter (preferably between 40 microns and 200 microns). At less than 30 microns average diameter, the abrasive is insufficiently abrasive to clean typical residues found on griddle surfaces. At greater than 250 microns average diameter, the particles are too abrasive and may undesirably scratch the griddle surface. Useful abrasive mineral includes flint, garnet, silicon carbide, pumice, aluminum oxide and mixtures thereof.

The weight ratio of abrasive to thermosetting binder is such that there is sufficient binder to adherently bond the filaments together and hold the abrasive particles yet not so much as to obscure the abrasive properties of the abrasive particles. For this purpose it has been found useful to use a weight ratio of abrasive particles to binder on the order of 1:1 – 4:1.

The coating weight of the thermoset resin and abrasive product mixture in a typical 5-mm thick product provides add-on weight of on the order of 580 grams per square meter uniformly distributed throughout the web. This coating may be accomplished by forming a dispersion of the abrasive particles and uncured thermosetting resin, utilizing a solvent or liquid carrier vehicle (if necessary), and spraying the major surfaces of the web with the dispersion to form a uniform coating. The freshly coated web is then passed through a forced air oven to evaporate the solvent (if one is used) and harden the resin.

The following examples, in which all parts are by weight unless otherwise indicated, further illustrate the invention.

EXAMPLE 1

A continuous strand 5 mm thick 95% void volume fiber glass web of about 225 denier glass filament bundles formed of about 45 filaments of 5 denier (approximate size) and sized with about 8% by weight (based on total web weight) of a polyester sizing resin (the sized web sold by Owens/Corning Company under the trade designation "M8620") was prebonded by using a two roll coater to impregnate the web. The prebonding composition consisted of 8.21 parts hydroxy terminated polyester having an OH number of 45–52 (commercially available from the Mobay Chemical Company under the trade designation "Multron R68"), 0.72 part trimethylol propane:glycerol (1:1) mixture, and 5.17 parts reaction product of 3 moles of toluene diisocyanate with 1 mole of trimethylol propane having an NCO content of 13% (commercially available from the Mobay Chemical Company as a 75% solids solution in ethyl acetate under the trade designation "Mondur CB-75"). The coated web was passed through a forced air oven heated at 150°–175° C to dry the prebonding composition, providing an add-on weight of 60–130 grams per square meter.

The prebonded web was spray coated on its major surfaces with a dispersion consisting of 14 parts of A-staged base-catalyzed phenol-formaldehyde resin having a phenol:formaldehyde mole ratio of 1:1 (100% solids) and 42 parts aluminum oxide having an average particle diameter of about 90 microns. The dispersion coating of the web was dried by passing it through a forced air oven heated at 150°–175° C, producing a dried add-on weight of 290 grams per square meter per side. The resultant product was cut to size and evaluated as described below.

EXAMPLES 2–10

Following the procedure of Example 1 except with the differences noted in the prebond resin and thermoset resin, Examples 2–10 were prepared.

| Ex. No. | Prebond Resin | Phenolic Resin |
|---|---|---|
| 2 | same as Example 1 | phenolic/amine terminated polyamide[1] |
| 3 | none | same as Example 1 |
| 4 | none | same as Example 2 |
| 5 | acrylic resin/talc[2] | " |
| 6 | polyurethane[3] | " |
| 7 | none | same as Example 1 |
| 8 | none | same as Example 2 |
| 9 | same as Example 1 | " |
| 10 | none | " |

[1]A 3:1 mixture of the phenol-formaldehyde resin (100% solids) described in Example 1 and a 100% solids amine terminated polyamide resin having a viscosity of about 700 cps, an acid number of about 3, an amine value of about 320 grams of resin per amine equivalent.
[2]A 1:1 mixture of a thermosetting acrylic resin sold by the Rohm and Haas Co. under the trade designation "Rhoplex HA-12" and talc.
[3]A reaction product of 10 parts of a blocked isocyanate prepolymer sold under the trade designation "Adiprene BL-16" and 1.2 parts methylenedianiline.

ABRASION TEST

A 100 mm diameter pad of abrasive product of the invention was tested for abrasiveness using a modified Schiefer abrasion test to abrade 100 mm diameter of 1.5 mm thick 1018 cold rolled steel test discs and measuring the weight loss of the steel disc in grams. The test discs were adhered to a rigid support of a Schiefer abrasion testing machine and the abrasive pad was rotated in contact with the disc surface at 250 rpm for 8 cycles of 1000 revolutions each under an applied force of 2.27 kg. The disc was then washed, dried, weighed and weight loss in grams recorded. This procedure was repeated for both surfaces of the abrasive pad.

Results were as follows:

| Cycle of 1000 rev. | Example 1 | | "Griddle Screen"[1] | |
|---|---|---|---|---|
| | Side 1 | Side 2 | Side 1 | Side 2 |
| 1 | 1.0633 | 1.1502 | .7263 | .7986 |
| 2 | .5527 | .2575 | .1569 | .4445 |
| 3 | .1951 | .1080 | .1290 | .2529 |
| 4 | .1138 | .0870 | .1451 | .1056 |
| 5 | .0919 | .0674 | .1592 | .0653 |
| 6 | .0529 | .0874 | .1616 | .0616 |
| 7 | .0756 | .0878 | .1468 | .0423 |
| 8 | .0936 | .0665 | .1392 | .0472 |

[1]"Griddle Screen" is the 3M Company's trade designation of a very successful commercial screen-like abrasive griddle cleaning product consisting of a glass mesh having 7 strands per cm in each direction of 600 denier fiber glass filaments which are coated with phenol-formaldehyde-oxide abrasive having an average diameter of about 100 microns.

WEAR TEST

Utilizing the Schiefer abrasion testing machine, a 100 mm diameter piece of general purpose "Safety-Walk" non-slip sheeting was used in place of the steel test disc to determine the wear life of the abrasive product. The non-slip sheeting consisted of a pressure-sensitive adhesive backed sheet of polyester film coated with a layer of polyurethane resin having dispersed therein silicon carbide abrasive particles of about 250 microns in average diameter to provide a roughened surface sheet. "Safety-Walk" is a registered trademark of the 3M Company. Water-saturated abrasive pads, 100 mm in diameter, were rotated against the non-slip sheeting under an applied force of 2.27 kg at 250 rpm for 6 cycles of 1000 revolutions each with new non-slip sheeting being used for each cycle of 1000 revolutions. The abrasive pad thickness was recorded before and after each cycle of 1000 revolutions to determine pad wear.

Results were as follows:

| Ex. No. | Pad Thickness (mm) | | Cycles |
|---|---|---|---|
| | Before | After | |
| 1 | 4.93 | 1.17 | 6 |
| 2 | 4.42 | 0.89 | 6 |
| 6 | 4.22 | 0.97 | 6 |
| 7 | 4.88 | wore out | <2 |
| 8 | 4.93 | " | <3 |
| 9 | 4.95 | 0.54 | 6 |
| 10 | 4.62 | wore out | <3 |

It should be noted that Examples 7, 8 and 10 were not prebonded and therefore they did not withstand the full wear test. An abrasive pad should be able to withstand 6 cycles of 1000 revolutions without wearing out in the test.

SURFACE ROUGHNESS

The degree of surface roughness of a flat 1018 cold rolled steel plate abraded with various grill cleaning devices was determined. Surface roughness was measured using an instrument for this purpose sold by the Clevite Company under the trade designation "Surfanalyzer 150".

The steel test surface was first abraded with the grill cleaning device for at least 1 minute or until a uniform scratch pattern developed. Abrasion was done dry, with cooking oil and with a 5% aqueous soap solution. The surface was then cleaned, dried and measured for surface roughness. Surface roughness was measured by passing the sensing brush of the instrument over a fixed distance on the abraded surface and recording electronically the surface roughness. Results, given as the arithmetic average in microns, were as follows:

| | Dry | 5% Soap Solution | Oil |
|---|---|---|---|
| pumice block | 1.12 | 1.03 | 1.22 |
| foamed glass block | 0.85 | 0.86 | 0.86 |
| "Griddle Screen" pad | 0.69 | 0.57 | 0.69 |
| Example 1 | 0.75 | 0.68 | 0.75 |

TEAR TEST

A 63 mm by 280 mm rectangular abrasive test pad was folded 180° on itself in both directions to produce a fold line perpendicular to the 280 mm side. The pad was clamped in fixed position on one side of the fold at the bottom of the pad in an Elmendorf tear tester with the fold in an upright position, after first making a 6 mm cut through the pad along the fold from the bottom. The opposite side of the pad was clamped also at the bottom to an arm capable of arcuate movement in the device, the arm being in mechanical communication with a raised weighted pendulum. As the pendulum was released, the arm moved in an arc causing a tearing force to be applied to the pad along the fold. Depending upon the ease of tearing, a relative tear rating from zero to 100 was assigned, zero being torn easily and 100 being extremely difficult to tear. The test was repeated with a new sample folded in the transverse direction.

Results were as follows:

| Ex. No. | Cross pad | Down pad |
|---|---|---|
| 1 | 46 | 52 |
| 2 | 54 | 43 |
| 3 | 6 | 12 |
| 4 | 4 | 9 |
| 5 | 35 | 40 |
| 6 | 43 | 38 |

Note that Examples 3 and 4, the only abrasive pads of this series not prebonded, tore easily while the pads of Examples 1, 2, 5 and 6 (all according to the present invention) showed excellent tear resistance.

ATTRITED RESIDUE TEST

The quantity of attrited residue obtained by using various abrasive griddle cleaning devices was measured. Each device was used to abrade the clean surface of a flat 1018 cold rolled steel plate for 1 minute without a lubricating liquid and under hand pressure. After such abrasion, the residue remaining on the plate surface was collected and weighed.

Results were as follows:

| Abrasive Device | Device Working Surface (sq. cm) | Device Total wt. loss (g) | Total Residue (g) | Residue per sq. cm of working surface (mg) |
|---|---|---|---|---|
| "Griddle Screen" pad | 160 | (0.24)[1] | 0.108 | 0.6 |
| pumice block | 188 | 30.5 | 29.8 | 159 |
| foamed glass block | 187 | 18.6 | 18.5 | 99. |
| Example 1 | 160 | (0.005)[1] | 0.14 | 0.9 |

[1]Weight gain

It should be noted that pumice and glass leave large quantities of residue while the product of the present invention leaves very little residue.

What is claimed is:

1. A low-density abrasive article, especially suited for scouring steel griddle surfaces without causing undesirable surface roughness thereto, comprising in combination:

1. a lofty, open, low-density, fibrous web having a void volume of 92 to 98% and being formed of a multitude of curved substantially continuous filament bundles disposed in substantially parallel planes one on another to form a web on the order of 2 to 10 mm thick, said filament bundles being about 150–250 denier and being comprised of a plurality of minute flexible glass filaments;
2. a relatively soft resinous prebonding composition having a Knoop hardness value no greater than about 4 thoroughly impregnating the glass filament bundles sufficient to bond them together at their points of intersection and form a prebonding interface between a hard thermoset resin and said glass filament bundles;
3. dispersed throughout said web and securely adhered to the exposed surface of said filament bundles, abrasive particles having an average particle size in the range of 40 to 250 microns;
4. a hard thermoset resin having a Knoop hardness value of at least 15 dispersed throughout and adhered to the filaments and abrasive particles.

2. The abrasive article of claim 1 wherein said glass filaments are on the order of 2 to 10 denier.

3. The abrasive article of claim 1 wherein said prebonding resin is an acrylate resin or a polyurethane.

4. The abrasive article of claim 1 wherein said prebonding resin is present in an amount on the order of 50–250 grams per sq. meter.

5. The abrasive article of claim 1 wherein said abrasive particles are on the order of 60 to 200 microns in average particle diameter.

6. The abrasive article of claim 1 wherein said abrasive particles are of an abrasive mineral selected from the group consisting of flint, garnet, silicon carbide, pumice and aluminum oxide and mixtures thereof.

7. The abrasive article of claim 1 wherein the hard thermoset resin is a phenolic resin.

8. The abrasive article of claim 1 wherein the weight ratio of abrasive particles to hard thermoset resin is on the order of 1:1– 4:1.

9. A low-density abrasive article, especially suited for scouring steel griddle surfaces without causing undesirable surface roughness thereto, comprising in combination:

1. a lofty, open, low-density, fibrous web having a void volume of 92 to 98% and being formed of a multitude of curved filament bundles disposed in substantially parallel planes one on another to form a web on the order of 2 to 10 mm thick, said filament bundles being about 150–250 denier and being comprised of a plurality of minute flexible glass filaments;
2. a relatively soft resinous prebonding composition having a Knoop hardness value no greater than about 4 thoroughly impregnating the glass filament bundles sufficient to bond them together at their points of intersection and form a prebonding interface between a hard thermoset resin and said glass filament bundles said prebonding resin being selected from the group consisting of acrylate resin and polyurethane;
3. dispersed throughout said web and securely adhered to the exposed surface of said filament bundles abrasive particles having an average particle size in the range of 40 to 250 microns;
4. a hard thermoset phenolic resin having a Knoop hardness value of at least 15 dispersed throughout and adhered to the filaments and abrasive particles.

* * * * *